US011802355B2

(12) United States Patent
Debuf et al.

(10) Patent No.: US 11,802,355 B2
(45) Date of Patent: Oct. 31, 2023

(54) WEAVING METHOD WITH CONTROL OR ADJUSTMENT OF THE YARN TENSION IN WARP THREADS. AND WEAVING MACHINE FOR PRODUCING A FABRIC USING SAID WEAVING METHOD

(71) Applicant: VANDEWIELE NV, Kortrijk/Marke (BE)

(72) Inventors: Geert Debuf, Drongen (BE); Hans Desmet, Koolskamp (BE)

(73) Assignee: VANDEWIELE NV, Kortrijk/Marke (BE)

( * ) Notice: Subject to any disclaimer, the term of this patent is extended or adjusted under 35 U.S.C. 154(b) by 148 days.

(21) Appl. No.: 17/617,288

(22) PCT Filed: Jun. 19, 2020

(86) PCT No.: PCT/IB2020/055784
§ 371 (c)(1),
(2) Date: Dec. 8, 2021

(87) PCT Pub. No.: WO2020/255061
PCT Pub. Date: Dec. 24, 2020

(65) Prior Publication Data

US 2022/0228302 A1 Jul. 21, 2022

(30) Foreign Application Priority Data

Jun. 20, 2019 (BE) ..... 2019/5401

(51) Int. Cl.
*D03D 49/04* (2006.01)
*D03D 49/14* (2006.01)
*D03D 39/00* (2006.01)

(52) U.S. Cl.
CPC ..... *D03D 49/14* (2013.01)

(58) Field of Classification Search
CPC ..... D03D 49/14; D03D 49/06; D03D 27/08; D03D 27/10; D03D 39/16; D03D 39/22
See application file for complete search history.

(56) References Cited

U.S. PATENT DOCUMENTS 4,574,846 A * 3/1986 Huemer ..... D03D 49/12 66/163
5,645,111 A * 7/1997 Lindblom ..... D03D 49/06 139/55.1

(Continued)

FOREIGN PATENT DOCUMENTS

EP 0382269 A1 8/1990
FR 3047744 A1 8/2017

OTHER PUBLICATIONS

International Search Report for PCT/IB2020/055784; dated Oct. 2, 2020.

*Primary Examiner* — Robert H Muromoto, Jr.
(74) *Attorney, Agent, or Firm* — FRESH IP PLC; Clifford D. Hyra; Aubrey Y. Chen

(57) ABSTRACT

Disclosed is a weaving method with which the yarn tension of several part groups with at least one warp thread per part group is controlled or adjusted separately, in order to follow a respective reference yarn tension profile during weaving, where, for at least one part group, the reference yarn tension profile is changed during weaving, where the reference yarn tension profile is determined and changed separately for at least two part groups, and where each reference yarn tension profile is selected from a collection of different reference yarn tension profiles. Also disclosed is a weaving machine provided with yarn tensioning elements, a storage unit in which said collection is provided, and a control or steering unit in order, in cooperation with the yarn tensioning elements, to adjust or control the yarn tension in separate warp threads using the indicated weaving method.

24 Claims, 6 Drawing Sheets

(56) References Cited

U.S. PATENT DOCUMENTS

| | | | | |
|---|---|---|---|---|
| 6,029,715 | A * | 2/2000 | Matsumoto | D03D 49/04 139/105 |
| 10,633,213 | B2 * | 4/2020 | Beauduin | D03D 49/16 |
| 10,655,252 | B2 * | 5/2020 | Debaes | D03D 27/16 |
| 11,028,507 | B2 * | 6/2021 | Vanderjeugt | D03D 13/004 |
| 11,130,652 | B2 * | 9/2021 | Beauduin | D02H 13/24 |
| 2022/0220643 | A1 * | 7/2022 | Parmentier | D03D 49/16 |
| 2022/0228302 | A1 * | 7/2022 | Debuf | D03D 49/14 |
| 2022/0316103 | A1 * | 10/2022 | Vanderjeugt | D03D 49/14 |
| 2022/0316106 | A1 * | 10/2022 | Debuf | D03J 1/00 |

* cited by examiner

WEAVING METHOD WITH CONTROL OR ADJUSTMENT OF THE YARN TENSION IN WARP THREADS. AND WEAVING MACHINE FOR PRODUCING A FABRIC USING SAID WEAVING METHOD

FIELD OF THE DISCLOSURE

This disclosure concerns firstly a method for weaving a fabric on a weaving machine, wherein in successive weft insertion cycles, at least one weft thread is inserted at a weft insertion level between warp threads, the warp threads in each weft insertion cycle are positioned relative to each weft insertion level such that the warp threads and the weft threads inserted in between together form a fabric according to a predefined weaving pattern, and the yarn tension of a group of warp threads which comprises at least some of the warp threads is controlled or adjusted by means of a yarn tensioning device.

Secondly, the disclosure also concerns a weaving machine comprising weft insertion means in order, in successive weft insertion cycles, to insert at least one weft thread at a weft insertion level between warp threads; shed-forming means for positioning the warp threads in each weft insertion cycle relative to each weft insertion level such that the warp threads and the weft threads inserted in between together form a fabric according to a predefined weaving pattern; and a yarn tensioning device for controlling or adjusting the yarn tension of a group of warp threads which comprises at least part of the warp threads.

BACKGROUND

A method and a weaving machine with the above-mentioned features are known from European patent application EP 0 382 269. On this weaving machine, the yarn tension of all warp threads together can be adjusted by means of the motor of the warp beam. This common yarn tension is adjusted in order to achieve a common target value which varies depending on the weaving pattern.

During a weaving process on a weaving machine, in each weft insertion cycle, the warp threads must be positioned relative to the weft insertion levels by the shed-forming means. To allow this successive shed formation to be carried out correctly, it is necessary for the warp threads to be held under a sufficiently high tension in each phase of the weaving process. In order to avoid the mutual entangling of warp threads as much as possible, a minimum yarn tension must always be guaranteed. Too low a yarn tension of the warp threads may also be disadvantageous for the fabric quality.

International patent application WO 2017/077454 A1 describes a yarn tensioning device in which several warp threads supplied from a bobbin creel to a weaving machine are guided between the bobbin creel and the weaving machine over the surface of a respective brake roller. Each brake roller can be driven by a respective motor in a rotation direction, wherein the roller pulls the yarn back in a direction opposite the feed direction of the warp threads. Each warp thread can be held under sufficient tension by controlling the motor torque of the brake roller concerned.

During a weaving process, the different warp threads are in mutually differing situations which also change over the course of the weaving process. These differing situations lead to different yarn tensions. Thus a warp thread may be subjected to certain forces, such as friction forces from contact with guide means or with other warp threads, which counter its movement towards the weaving machine and which are not equal for all warp threads, and which also vary for each warp thread over the course of the weaving process. In the existing methods and weaving machines, a yarn tension is imposed on all warp threads which is sufficiently high for a good progress of the weaving process in all circumstances. As a consequence, the total yarn tension applied is much higher than necessary for certain warp threads, at least during specific phases of the weaving process. As a result, the moving machine parts are loaded more heavily than necessary. Higher yarn tensions also mean greater wear on components and more frequent damage to warp threads, as well as a higher energy consumption of the weaving machine.

Thus the yarn tension in a warp thread varies between a minimum value and a maximum value during the course of each positioning by the shed-forming means. This minimum value must be sufficiently high to allow the shed formation to proceed correctly and to prevent mutual contact and entangling of the warp threads. During the weaving process, accordingly also yarn tensions are achieved which are much higher than necessary for a good progress of the weaving process. As a result, the moving machine parts are loaded more greatly than necessary. The main disadvantages of excessive yarn tensions are summarised in the preceding paragraph.

SUMMARY

It is an object of this disclosure to reduce the disadvantages outlined above by providing a weaving method and a weaving machine with which the yarn tensions in the warp threads can be reduced without adversely affecting the good progress of the weaving process and the fabric quality. The phrase "reducing yarn tensions" in this description means reducing the maximum values of the yarn tension and/or reducing the mean value of the yarn tension over a specific period, for example over a specific part of a weaving machine cycle or over one or more weft insertion cycles.

This object is achieved by providing a method for weaving a fabric on a weaving machine, with the features specified in the first paragraph of this description, wherein according to this disclosure the group of warp threads comprises several part groups with at least one warp thread; wherein the yarn tension of the warp threads is controlled or adjusted separately per part group in order, during weaving, to follow a respective reference yarn tension profile; wherein for at least one part group, the reference yarn tension profile to be followed is changed during weaving; wherein for at least two part groups, the reference yarn tension profile to be followed during weaving is determined and changed separately, and wherein each reference yarn tension profile is selected from a collection of at least two different reference yarn tension profiles.

We emphasise that the term "a part group" and "a part group of warp threads" in this patent application refers to "a number of warp threads of the group of warp threads for which the yarn tension is adjusted or controlled, wherein the number is 'at least one'". The expressions "a part group" and "a part group of warp threads" are furthermore also used in this patent application to mean "the at least one warp thread of a part group". Thus for example the phrase "the yarn tension in a part group" means "the yarn tension in the at least one warp thread of a part group".

A property which influences the yarn tension of a warp thread supplied from a yarn store to a fabric being produced on a weaving machine, in this patent application, is called "a yarn tension influencing property". Some examples of "yarn tension influencing properties" are "the weave structure of the warp thread in the fabric", "the path followed by the warp thread between the yarn store and the fabric", and "the resistance forces exerted on a warp thread which counter the movement of the yarn to the weaving machine".

A yarn tension influencing property of a warp thread in this patent application means a specific property of a warp thread with several (at least two) statuses or conditions. Each status of a yarn tension influencing property corresponds to a respective different influencing of the yarn tension. Thus for example "the weave structure of a warp thread" means a yarn tension influencing property for which, for example, a first status is "the weave status of a pile-forming warp thread", and a second status is "the weave status of a non-pile-forming warp thread". In the first status, the yarn tension of the warp thread is influenced differently from in the second status.

The status of a yarn tension influencing property may change over time for a specific warp thread, and different warp threads may have a different status of a yarn tension influencing property.

According to this disclosure, a different reference yarn tension profile may be determined for different part groups. This is necessary for example if one or more yarn tension influencing properties have a different status for different part groups. For the warp threads of a specific part group, the reference yarn tension profile to be followed may be changed. This is necessary for example if the status of one or more yarn tension influencing properties of this warp thread has changed.

The forces which counter the movement of the yarn may for example be the result of the resistance or the friction applied to the warp thread by contact with the machine components, e.g. yarn guide means, or by contact with other warp threads. Thus for example the inertia of a yarn storage bobbin from which the warp thread is unwound by rotation of the bobbin, and/or the place of unwinding and the bobbin diameter, and/or the number or length of the guide means for a supplied warp thread, and/or contact with other warp threads on the path from the yarn store to the fabric, may create counteracting forces which influence the yarn tension.

The "place of unwinding" or "bobbin places from which a warp thread is unwound" in the above paragraph and below in this description and in the claims means the following. When the yarn is unwound from the rolling bobbin, the point at which the yarn is taken off the bobbin moves over the length of the bobbin. The place on the bobbin, viewed in the length direction of the bobbin, at which a warp thread leaves the bobbin during its unwinding, is called the "bobbin place from which the warp thread is unwound". The fact that this "unwinding place" changes also introduces a variation in the yarn tension with a frequency which is dependent on the bobbin diameter. The bobbin place from which the warp thread is unwound, known briefly as "the bobbin place", is thus also a yarn tension influencing property.

Properties which influence the yarn tension in a warp thread are preferably properties for which the warp thread is subject to one or more forces which counter the movement of the warp thread in the direction of the weaving machine. If the tensile force exerted on the warp thread by the weaving machine remains constant, the yarn tension in the warp thread will be greater as the countering forces become greater, and become smaller as these forces become smaller. The expression "yarn tension influencing property(ies) of a warp thread" may, in the preferred case, in this description and the claims, be replaced by the expression "yarn tension influencing resistance force(s) on the warp thread".

Thus for example it may be that, in the weaving zone of a weaving machine, a warp thread must extend through a layer of warp threads running alongside one another to the fabric in which this warp thread is processed. This situation in which the warp thread, by contact with several warp threads, e.g. when crossing a layer of warp threads running alongside one another, meets a specific level of resistance, is a condition or status of the yarn tension influencing property "the resistance forces exerted on a warp thread which counter the movement of the yarn towards the weaving machine". According to this disclosure, for example for a warp thread which is in this status, an adapted reference yarn tension profile is provided. Alternatively or additionally, according to this disclosure, for some or all warp threads which together form a layer of warp threads running alongside one another, an adapted reference yarn tension profile may be provided whereby the warp thread undergoes less resistance when passing through this layer.

Also, the place taken by a warp thread on the weaving machine is a property which influences the yarn tension. Thus a warp thread which is more centrally located in the weaving machine generally meets a lower resistance against its movement towards the weaving machine than a warp thread which is at a side edge of the weaving machine. According to this disclosure, respective adapted reference yarn tension profiles may also be provided for these different statuses.

In the method according to this disclosure, for at least one part group, the reference yarn tension profile to be followed is changed during weaving as a function of the status of a yarn tension influencing property of each warp thread of the part group. The "weave status of a warp thread" in this description means the succession of at least two weave structure positions which the warp thread takes up in the fabric according to the weaving pattern. Thus for example the weave status of a pile-forming pile-warp thread is the succession of weave structure positions which the pile-warp thread takes up in successive weft insertion cycles during face-to-face weaving, wherein it is interlaced alternately over a weft thread of the top ground fabric and a weft thread of the bottom ground fabric; or the weave status of a non-pile-forming pile-warp thread is the succession of weave structure positions through which the pile-warp thread is incorporated into one of the ground fabrics in successive weft insertion cycles during face-to-face weaving. It may for example also be a weave status of a pile-warp thread at the transition from a pile-forming part to a non-pile-forming part, which means that in successive weft insertion cycles, the pile-warp thread forms a final pile loop over a weft thread of a ground fabric and is then incorporated into the ground fabric; or a weave status of a pile-warp thread at the transition from a non-pile-forming part to a pile-forming part, which means that in successive weft insertion cycles, the pile-warp thread is first incorporated into a ground fabric and thereafter forms a first pile loop over a weft thread of a ground fabric.

If one or more yarn tension influencing properties have a status which differs for different part groups, the reference yarn tension profile to be followed in these part groups may be adapted to this. If the status of one or more yarn tension influencing properties changes during the weaving process, in addition, the reference yarn tension profile in the different part groups may be adapted to these modified statuses separately and if necessary differently. The yarn tension may thus on average be kept slightly lower, while also the maximum values of the yarn tension are not as high.

Because for example the yarn tension profile in a pile-warp thread which forms a pile differs greatly from the yarn tension profile in a pile-warp thread which is incorporated into a ground fabric without forming pile, for these different weave statuses, different reference yarn tension profiles may be provided which allow the pile formation of each pile-warp thread and the incorporation of each non-pile-forming warp thread to take place with yarn tensions which have less high peaks and less low troughs, and hence vary less over the course of the weaving process. In this way, the yarn tension may also on average be lower than according to known methods.

By keeping better control of the yarn tensions in the warp threads, the fabric quality may also be improved in comparison with existing weaving methods.

Thus a reference yarn tension profile for the weave status of a pile-warp thread, on transition from a pile-forming part to a non-pile-forming part or vice versa, may be aimed at tightening more tightly the last pile loop of the finishing pile formation or the first pile loop of the starting pile formation, so as to improve the appearance of the fabric on the back.

The term "reference yarn tension profile" in this description and the claims means for example a reference value or a series of successive reference values for the yarn tension in at least one warp thread, which must be adapted as a function of a time period and/or a state of the weaving machine (e.g. the position of the main shaft of the weaving machine) and/or a phase of the weaving process and/or the value of one or more parameters or variables during the weaving process. These reference values may be stored in a storage unit or memory of a computer or processor, or may also be provided in the form of a table or list.

If for example for a specific pile-warp thread, a "reference yarn tension profile for pile formation" is selected which contains a series of successive reference values, these reference values are regarded, for a specific time period or during a specific phase of a weaving process (e.g. during one or more weft insertion cycles or jacquard cycles) or between two well-defined machine states (e.g. positions of the main shaft of the weaving machine), as a succession of target values for the yarn tension which are made available to the control or steering system of the yarn tensioning element concerned.

If, for the same pile-warp thread, later in the weaving process a "reference yarn tension profile for non-pile formation" is selected which contains a series of successive reference values, these reference values (which are now completely different) are regarded as the succession of target values to be applied.

The selection of reference yarn tension profiles to be applied is made for example per part group at well-defined times, each preceding a weft insertion cycle (pick by pick), wherein for example the current values of certain machine parameters are taken into account. The selection may be determined per weft insertion cycle during weaving, wherein in each case it is determined two or more weft insertion cycles ahead.

The selection or part thereof may, additionally or alternatively, be determined for example before weaving begins on the basis of previously available information, for example on the basis of the weaving pattern.

It will be clear that a "reference yarn tension profile" may also contain a single reference value for the yarn tension. A "succession of target values" in this description must then also be understood as "a single target value or a succession of two or more target values".

If a "reference yarn tension profile" contains various reference values, these are also not necessarily different. One or more, or all, reference values of a "reference yarn tension profile" may be identical.

In a preferred method and weaving machine, a "reference yarn tension profile" is a continuous function (a reference graph line) with continuously varying tension values as a function of time and/or the state of the weaving machine and/or an associated jacquard device and/or the course of the weaving pattern.

In a preferred method, a respective different reference yarn tension profile is provided for at least two different statuses of a yarn tension influencing property of a warp thread, and for at least one part group, the reference yarn tension profile to be followed during weaving is determined and changed as a function of the status of each warp thread of the part group.

The status of the yarn tension influencing property may be established or detected during weaving or may be determined in advance based on the weaving pattern and/or based on the proposed path of the warp threads from the yarn store, e.g. a bobbin creel, to the fabric.

In a greatly preferred method, the at least two different statuses of the yarn tension influencing property of a warp thread are:

- at least two different phases of the weaving cycle in which a warp thread is processed into the fabric, or
- at least two different places on the weaving machine at which a warp thread is located during weaving process, or
- at least two different paths which a warp thread follows from a yarn store to the fabric, or
- at least two different degrees of contact which a warp thread makes with other warp threads and/or with yarn guide means on its path from a yarn store to the fabric, or
- at least two different sizes of forces which counter the movement of a warp thread towards the weaving machine on its path from a yarn store to the fabric, or
- at least two different inertias and/or two different diameters of a yarn storage bobbin from which the warp thread is unwound during the weaving process by rotation of the yarn storage bobbin, or
- at least two different bobbin places from which the warp thread is unwound.

The adjustment or control may also take place as a function of a combination of two or more of the different statuses listed above of a yarn tension influencing property.

In order to take account of a periodically changing place of unwinding from a bobbin, a reference yarn tension profile may be provided which takes account of the periodic tension variation and the frequency thereof which is dependent on the bobbin diameter.

As stated, it is particularly advantageous if, per part group of at least one warp thread, the yarn tension can be adapted during the weaving process to the circumstances which influence the yarn tension. Thus, at any moment and per group of yarn threads, preferably per yarn thread, the yarn tension may be adjusted such that this is sufficient for a good progress of the weaving process and provides an optimal fabric quality but is not too high, so that the wear on machine components, damage to the warp threads and the energy consumption of the machine can be perceptibly reduced.

According to a greatly preferred method according to the disclosure, a respective different reference yarn tension profile is provided for at least two different weave statuses of a warp thread in the fabric to be woven, and for at least one part group, the reference yarn tension profile to be followed during weaving is determined and changed as a function of the weave status for each warp thread of the part group, as provided according to the weaving pattern.

For each warp thread, the weaving pattern determines a succession of weave structure positions in the fabric to be woven. The weave structure position of a warp thread is the position of said warp thread relative to each weft thread which is inserted in the same weft insertion cycle. The profile of the yarn tension in a warp thread depends amongst others on the succession of weave structure positions of this warp thread. A succession of at least two weave structure positions of a warp thread in the fabric is called the weave status of the warp thread.

For different functions of the same pile-warp thread in the fabric, there is a different succession of weave structure positions and hence a different weave status. Thus a pile-warp thread which forms pile has a different weave status from the same pile-warp thread which, at another place in the fabric, is incorporated into the ground fabric. The weave status of a warp thread thus changes during the weaving process depending on its successive weave statuses which are established in the weaving pattern.

For other warp threads also, such as e.g. binding warp threads and tight warp threads, reference yarn tension profiles belonging to their possible weave statuses may be determined.

In a greatly preferred method, at least a number of part groups, preferably all part groups, comprise only one warp thread. Thus the yarn tensions may be controlled or adapted separately in a number of, preferably all, warp threads, according to respective reference yarn tension profiles which may be changed during the weaving process by selection from a collection of reference yarn tension profiles.

The changes in reference yarn tension profiles preferably take into account the circumstances of the warp thread, preferably depending on the status of a yarn tension influencing property, some non-limitative examples of which were given earlier in this description.

A first, a second and a third particularly preferred method are methods for weaving pile fabrics, wherein at least one ground fabric is woven from warp threads and weft threads, and wherein pile-warp threads are provided in order to form pile and/or be incorporated into a ground fabric without forming pile, according to the weaving pattern.

According to the first particularly preferred method, a pile-forming pile-warp thread has a first weave status and a pile-warp thread which is incorporated into a ground fabric without forming pile has a second weave status, a first and a second reference yarn tension profile are provided for the first and second weave statuses respectively, and the reference yarn tension profile to be followed during weaving is determined and changed as a function of the presence or absence of a first or a second weave status of each pile-warp thread of the part group, according to the weaving pattern.

Because a pile-forming pile-warp thread forms pile loops in the top and the bottom ground fabric alternately, while a non-pile-forming pile-warp thread is incorporated in extended form into one of the ground fabrics, the yarn consumption of pile-forming pile-warp threads is much greater than that of non-pile-forming pile-warp threads. The yarn tensions of these two weave statuses therefore develop very differently. Accordingly, it is particularly advantageous if the yarn tensions of these two different weave statuses of a pile-warp thread can be adapted or controlled separately, so that a differently adapted reference yarn tension profile is followed.

According to the second particularly preferred method, at least one pile-warp thread has a pile-forming part and a non-pile-forming part, wherein the transition from a pile-forming part to a non-pile-forming part of a pile-warp thread has a third weave status, and a third reference yarn tension profile is provided for the third weave status, and the reference yarn tension profile to be followed during weaving is determined and changed as a function of the presence or absence of a third weave status of each pile-warp thread of the part group, according to the weaving pattern.

According to the third particularly preferred method, at least one pile-warp thread has a pile-forming part and a non-pile-forming part, wherein the transition from a non-pile-forming part to a pile-forming part of a pile-warp thread has a fourth weave status, and a fourth reference yarn tension profile is provided for the fourth weave status, and the reference yarn tension profile to be followed during weaving is determined and changed as a function of the presence or absence of a fourth weave status of each pile-warp thread of the part group, according to the weaving pattern.

A greatly preferred method is a face-to-face weaving method in which two ground fabrics are woven one above the other from respective warp threads and weft threads, wherein the pile-warp threads on the mutually facing sides of the ground fabrics form pile on at least one of the ground fabrics, in that pile-warp threads are interlaced alternately into the one and the other ground fabric and cut through between the two ground fabrics in order to form cut pile on both ground fabrics, and/or in that pile loops are formed on at least one of the ground fabrics, and/or in that pile-warp threads on at least one of the ground fabrics form ribs running over weft threads on the fabric surface.

Preferably, a fabric is woven with a cut pile and/or a loop pile and/or a rib-forming structure, such as amongst others a false bouclé fabric and a fabric with sisal appearance.

In a particularly preferred embodiment, to influence the yarn tension of the warp threads, per part group a yarn tensioning element is provided which comprises at least one roller that can be driven by an electric motor and is in contact with each warp thread of the part group, wherein the electric motor has a cogging torque which is at most 20% of the nominal torque of the motor.

Preferably, the cogging torque is at most 15% of the nominal torque of the motor. As described in more detail later in this description, this ensures a rapid and dynamic response of the motor.

More preferably, the torque is at least 5% of the nominal torque of the motor. This ensures that the motor has a high accuracy in a low force range.

Preferably, per part group, a yarn tensioning element is provided, the electric motor of which has a nominal torque of at least 0.005 Nm and at most 0.2 Nm.

Preferably, a motor with a nominal torque of at least 0.005 Nm and at most 0.1 Nm is provided when the diameter of the roller that can be driven by the motor is at least 10 mm and most 20 mm, and a motor with a nominal torque of at least 0.01 Nm and at most 0.2 Nm is provided when the diameter of the roller that can be driven by the motor is at least 20 mm and at most 40 mm.

The object of this disclosure as outlined above is also achieved by provision of a weaving machine with the features from the second paragraph of this description, in which the yarn tensioning device comprises several yarn tensioning elements which are provided for changing the yarn tension in the warp threads of the respective part groups of the group of warp threads, and comprises a control or steering unit which is provided, in cooperation with the yarn tensioning elements, to adjust or control the yarn tension in the warp threads per part group separately in order, during weaving, to follow a respective reference yarn tension profile; wherein each part group comprises at least one warp thread; wherein the control or steering unit is provided to change the reference yarn tension profile to be followed during weaving for at least one part group; wherein the yarn tension device comprises a storage unit in which a collection of at least two different reference yarn tension profiles is provided; and wherein the control or steering unit is provided, for at least two part groups, to determine the reference yarn tension profile to be followed during weaving by selection from said collection.

The yarn tensioning device preferably comprises measuring means, in order, in at least one warp thread per part group, to measure the yarn tension or a variable which is a measure of the yarn tension. Preferably, a control unit is also provided with means for repeatedly or continuously comparing the measured yarn tension, or the variable which is a measure of the yarn tension, with a reference value, and when a difference is established between the measured yarn tension or variable on one side and the reference value on the other, generating a control signal for driving a yarn tensioning element (e.g. by adapting the current with which the motor is controlled or by adapting the motor torque) such that the difference between the measured value and the reference value is reduced.

A steering unit preferably comprises a regulator which is provided, on setting a specific target value for the yarn tension, to generate a steering signal for driving a yarn tensioning element (e.g. by adapting the current with which the motor is controlled or by adapting the motor torque) such that the target value is approached or reached. The regulator is preferably a regulator of the type with "feed-forward control".

In a particular embodiment of a steering unit or a control unit, machine parameters may be made available, such as a machine position or machine speed or data connected with the weaving pattern or the weave structure, and one or more of these parameters may be used for control or adjustment.

If one or more yarn tension influencing properties have a status which differs in different part groups, then in this weaving machine different reference yarn tension profiles may be determined for these part groups, and these reference yarn tension profiles may be adapted separately and if necessary differently in the different part groups during the weaving process, according to statuses of yarn tension influencing parameters which have changed during the weaving process. The yarn tension may thereby on average be kept a lot lower while the maximum values of the yarn tension are not as high. For a more detailed explanation of this with examples of various yarn tension influencing properties, we refer to the text earlier in this description relating to the method according to this disclosure.

The yarn tensioning device comprises for example detection means for detecting the status of one or more yarn tension influencing properties during weaving, and/or comprises storage means and/or data-processing means in order to predefine the time or phase of the weaving process at which the yarn tension influencing property has a specific status or undergoes a status change, for example on the basis of the weaving pattern and/or on the basis of the proposed path of warp threads between the yarn store and the fabric.

A yarn store is preferably a quantity of yarn that is wound on a bobbin which, together with a number of other bobbins, is held in a bobbin creel. Such a bobbin is preferably rotatable for unwinding the warp thread by its rotation ("in déroulé"). In another possible embodiment, the bobbin is fixed and the yarn is unwound over the end of the bobbin without rotation of the bobbin ("in defile").

Preferably, in this weaving machine and according to the method of this disclosure, a control system is applied using a "bidirectional forced feed-forward function". This means that, on a change of movement of the yarn, the yarn tensioning unit intervenes to facilitate this change so as to react more quickly.

In a possible configuration according to this disclosure, a number of yarn tensioning elements are installed between a yarn storage device, e.g. a bobbin creel, and a weaving machine. Each yarn tensioning element comprises a roller that is driven by a motor and that is in contact with at least one warp thread which runs from its yarn store to the fabric in a feed direction. In order to guarantee sufficient yarn tension of a warp thread in the zone between the yarn tensioning element and the fabric, by adaptation of a motor torque, the roller cooperating therewith is driven in a rotation direction in which the yarn is drawn back in a direction which is opposite the feed direction.

According to a first preferred control system, if yarn is recuperated from the weaving machine, i.e. if the movement direction of the yarn runs opposite the feed direction of the yarn, the motor torque is increased for a limited time in order to be able to recuperate with more force.

According to a second preferred control system, which may be used separately or together with the first preferred control system, if the weaving machine is taking yarn from the yarn store, i.e. the movement direction of the yarn is the same as the feed direction of the yarn, the motor torque is reduced for a limited time so that the yarn can be taken from the store more easily. Thus less tension is built up in the yarn before the yarn begins to move. Because less tension has built up, the peak yarn tension is lower and less yarn is taken than without this steering or control, whereby the quantity of yarn moved towards the weaving machine correlates better with the quantity of yarn required for weaving. In other words, there is less overshoot.

The first and/or second preferred control system may also be used if a change of movement of the yarn can be predicted, for example from the pattern.

Preferably, in the first and/or second preferred control system, the duration of intervention of the control system is determined, in other words the period during which the torque is increased or decreased. This may take place for a predefined fixed time duration (expressed in time units e.g. seconds, or expressed as a number of degrees of the machine cycle). Alternatively, it may be determined that the intervention of the control system takes place for the entire duration of recuperation of yarn or taking of yarn.

In a weaving machine according to this disclosure, for at least one part group, the reference yarn tension profile to be followed is changed during weaving as a function of the status of a yarn tension influencing property of each warp thread of the part group.

Preferably, the weaving machine is provided with a group of warp threads which comprises several part groups with at least one warp thread, wherein in the storage unit a respective different reference yarn tension profile is provided for at least two different statuses of a yarn tensioning influencing property of the warp thread, and the control or steering unit is provided, for at least one part group, to determine the reference yarn tension profile to be followed during weaving and change this as a function of the status of a yarn tension influencing property of each warp thread of the part group.

The term "storage unit" in this description and in the claims means any data carrier or means in which data can be stored at least temporarily. The storage unit preferably cooperates with the control unit or steering unit in order to determine and change the reference yarn tension profile to be followed during weaving. Preferably, the storage unit cooperates with a unit which is provided to process data, such as a computer or a processor.

In a particular embodiment, the at least two different statuses of a yarn tension influencing property of a warp thread, for which a respective different reference yarn tension profile is provided, are:

- at least two different phases of the weaving cycle in which a warp thread is processed into the fabric, or
- at least two different places on the weaving machine at which a warp thread is located during weaving process, or
- at least two different paths which a warp thread follows from a yarn store to the fabric, or
- at least two different degrees of contact which a warp thread makes with other warp threads and/or with yarn guide means on its path from a yarn store to the fabric, or
- at least two different sizes of forces which counter the movement of a warp thread towards the weaving machine on its path from a yarn store to the fabric, or
- at least two different inertias of a yarn storage bobbin from which the warp thread is unwound during the weaving process by rotation of the yarn storage bobbin, or
- at least two different bobbin places from which the warp thread is unwound.

In a preferred embodiment, the yarn tensioning device of this weaving machine comprises a storage unit in which a respective different reference yarn tension profile is provided for at least two different weave statuses of a warp thread in the fabric to be woven, and the control or steering unit is provided, for at least one part group, to determine the reference yarn tension profile to be followed during weaving and change this as a function of the weave status for each warp thread of the part group, as provided according to the weaving pattern.

In a preferred embodiment, a number of part groups, preferably all part groups, comprise only one warp thread.

A first, a second and a third preferred embodiment of the weaving machine according to this disclosure are provided for weaving pile fabrics in which at least one ground fabric is woven from warp threads and weft threads, and wherein pile-warp threads are provided in order to form pile and/or be incorporated into a ground fabric without forming pile, according to the weaving pattern.

In the first particularly preferred weaving machine, a pile-forming pile-warp thread has a first weave status and a pile-warp thread which is incorporated into a ground fabric without forming pile has a second weave status, and a first and a second reference yarn tension profile are provided for the first and second weave statuses respectively, and a control or steering unit is provided in order to determine the reference yarn tension profile to be followed during weaving and change this as a function of the presence or absence of a first or a second weave status of each pile-warp thread of the part group according to the weaving pattern.

In the second particularly preferred weaving machine, at least one pile-warp thread has a pile-forming part and a non-pile-forming part, wherein the transition from a pile-forming part to a non-pile-forming part of a pile-warp thread has a third weave status, and a third reference yarn tension profile is provided for the third weave status, and the control or steering unit is provided in order to determine the reference yarn tension profile to be followed during weaving and change this as a function of the presence or absence of a third weave status of each pile-warp thread of the part group according to the weaving pattern.

In the third particularly preferred weaving machine, at least one pile-warp thread has a pile-forming part and a non-pile-forming part, wherein the transition from a non-pile-forming part to a pile-forming part of a pile-warp thread has a fourth weave status, and a fourth reference yarn tension profile is provided for the fourth weave status, and the control or steering unit is provided in order to determine the reference yarn tension profile to be followed during weaving and change this as a function of the presence or absence of a fourth weave status of each pile-warp thread of the part group according to the weaving pattern.

The weaving machine according to this disclosure is preferably a face-to-face weaving machine. Preferably, this cooperates with a jacquard device for positioning the warp threads.

The weaving machine is provided for example to weave two ground fabrics one above the other from respective warp threads and weft threads, wherein the pile-warp threads on the mutually facing sides of the ground fabrics form pile on at least one of the ground fabrics, in that pile-warp threads are interlaced into the one and the other ground fabric alternately and cut through between the two ground fabrics so as to form cut pile on both ground fabrics, and/or in that pile loops are formed on at least one of the ground fabrics, and/or in that pile-warp threads on at least one of the ground fabrics form ribs running over weft threads on the fabric surface.

In a particularly preferred embodiment, said yarn tensioning elements each comprise at least one roller that can be driven by an electric motor that is provided to be in contact with at least one warp thread of the part group, wherein said electric motor has a cogging torque which is at most 20% of the nominal torque of the motor. Preferably, the cogging torque is at most 15% of the nominal torque of the motor.

More preferably, the torque is at least 5% of the nominal torque of the motor.

The term "cogging torque" is the more common term for "friction torque". The consequence of a cogging torque is a torque ripple or speed ripple. A low cogging torque thus introduces little or no torque ripple or speed ripple. Thanks to this property, the yarn tension may be controlled in a more stable fashion. The cogging torque may also be regarded as the resistance to rotation when the motor is not energized, expressed as a torque, and is determined by the structural properties of the motor (power, number and shape of magnets, interaction with the stator windings).

If for example a motor with a nominal torque of 10 mNm is used, it is preferred if this motor has a cogging torque which is at most 2 mNm. In other words, the torque can be set steplessly from 2 mNm. A higher cogging torque ensures that the controlled torque has no influence on the "mechanical resistance".

Because a limited amount of cogging torque is necessary because of its damping effect, it is preferable to have a cogging torque which is no lower than 5% of the nominal torque (0.5 mNm if the nominal torque is 10 mNm). If the cogging torque is too low, the motor reacts in uncontrolled fashion in the low torque range.

In a greatly preferred embodiment, the yarn tensioning elements comprise an electric motor with a nominal torque which is at least 0.005 Nm and at most 0.2 Nm.

Preferably, a motor with a nominal torque of at least 0.005 Nm and in most 0.1 Nm is provided if the diameter of the roller that can be driven by the motor is at least 10 mm and most 20 mm, and a motor with a nominal torque of at least 0.01 Nm and at most 0.2 Nm is provided if the diameter of the roller that can be driven by the motor is at least 20 mm and most 40 mm.

The roller driven by the motor is also called the brake roller.

The motor which drives the brake roller in order to keep the yarn under tension can preferably be operated in generator function in order to keep the yarn under tension. By allowing a motor to supply a variable torque to the brake roller, it is easier to respond to deviating and/or changing properties of yarn and/or a path change of the yarn and/or changes in the behaviour of the weaving machine. The motor torque may for example be much lower when the machine is stationary (just enough to keep the yarn stretched) than when the machine is running.

In order to recuperate yarn from the weaving machine (which is necessary for example because of shed formation), the motor can also be operated in motor function in order to move the yarn in a direction opposite the feed direction of the yarn. In addition, it may also be useful to design the motor so as to be operable in motor function in order to move the yarn in the feed direction, so as to be able to take extra yarn from the yarn storage system. Preferably, a central control system is provided, preferably also with means for supplying the energy generated by the motor during generator function directly to the control system of the yarn tensioning system.

Preferably, measuring means are also provided for determining the length of the yarn taken by the weaving machine. Per brake roller, the length of the yarn held under tension by this brake roller can be calculated from the number of revolutions of the brake roller, or from the angular rotation of the motor and the diameter of the brake roller, without the need for supplementary length measurement sensors. The measurement means for this comprise for example the necessary calculation means.

Preferably, communication means are also provided for receiving signals from the weaving machine relating to the operation and/or state of the machine, and measuring means for measuring parameters relating to the operation of the yarn tensioning device, and tension monitoring means for monitoring the parameters relating to the operation of the yarn tensioning device relative to the signals received from the weaving machine. The signals relating to the operation of the weaving machine give the current state of the weaving machine and may relate to the standstill of the machine, the functioning of the machine, the speed of the machine, the position of the main shaft of the weaving machine, the phase of the weaving process etc.

The tension monitoring means are preferably also provided in order, on the basis of the current state reported by the weaving machine, to predict the expected operation of the yarn tensioning device. The yarn tensioning device is usually preferably provided with a tension measuring device for measuring the yarn tension. By measuring the yarn tension, various extra detection systems may also be provided. Thus for example it is possible, using the measured yarn tension, to detect not only a yarn breakage and/or over-tensioning of the yarn, but also irregularities or knots in the yarn. It is for example also possible, using the same brake roller, to keep under tension several yarns with the same yarn characteristics and the same path to be followed.

The motor of the yarn tensioning system according to this disclosure is preferably a DC motor or a brushless AC motor. More preferably, this motor is a brushless DC motor, even more preferably a brushless DC motor with an external rotor (a type of motor in which the stator is stationary and the rotor rotates) provided with Hall sensors, preferably configured as a pancake motor because of the compactness of such a type of motor, its economic availability and in view of the fact that, in the present application, little energy is produced or required. The Hall sensors detect the position of the rotor relative to the stator in order to be able to energize the stator windings in the correct sequence. By using the information from these Hall sensors, the position of the motor shaft can be determined, whereby an encoder is superfluous. Also, the length of the yarn consumed can be determined in this way.

By minimising the slippage of the yarn on the brake roller, the yarn tension may be kept constant irrespective of thread properties, and the accuracy of any measurements can be increased. The slippage of the yarn on the brake roller can be minimised in several ways. Alternatively or additionally, the brake roller may be designed for wrapping the yarn several times around it. As another alternative or in addition, the brake roller may have a running surface which is provided with an anti-slip layer and/or with a profiling.

The motor may be of either the axial flux design type or of the radial flux design type.

The motor may also be provided with an external electromechanical device or sensor (called an encoder) which is provided for converting the angular position of a shaft into analogue or digital signals. In this way, the position of the motor shaft is known. Because the yarn moves over the roller without slippage, the length of the yarn used may be derived from the number of degrees of rotation of said roller. Preferably however, because of the cost price and operating reliability, no such external encoders are used.

BRIEF DESCRIPTION OF THE DRAWINGS

The disclosure is now explained further with reference to the description which follows of a possible embodiment of a yarn tensioning device according to this disclosure and a possible weaving method according to this disclosure. It is emphasised that the device and method described are merely examples of the general principle of the disclosure, and thus may in no way be regarded as a limitation of the scope of protection or of the area of application of the disclosure.

In this description, reference signs are used to refer to the attached figures, in which:

FIG. 5 is related to a pile-forming pile-warp thread on use of a face-to-face weaving machine from FIG. 1 and a yarn tensioning device which, according to the disclosure, adjusts the yarn tension in the warp threads in order to follow a reference yarn tension profile;

DETAILED DESCRIPTION

Firstly, with reference to FIGS. 1 to 4, it is explained how, during weaving on a face-to-face weaving machine, the yarn tension profile develops in a pile-warp thread which forms pile and in a pile-warp thread which is incorporated into one of the ground fabrics. It is shown that these yarn tensions differ greatly from each other, and it is also shown that the yarn tension in a pile-forming and in a non-pile-forming pile-warp thread varies greatly over the course of the weaving process. The yarn tension profile shows great differences between the maximum values (peaks) and the minimum values (troughs) for both the pile-forming and non-pile-forming pile-warp threads.

Figure 5:
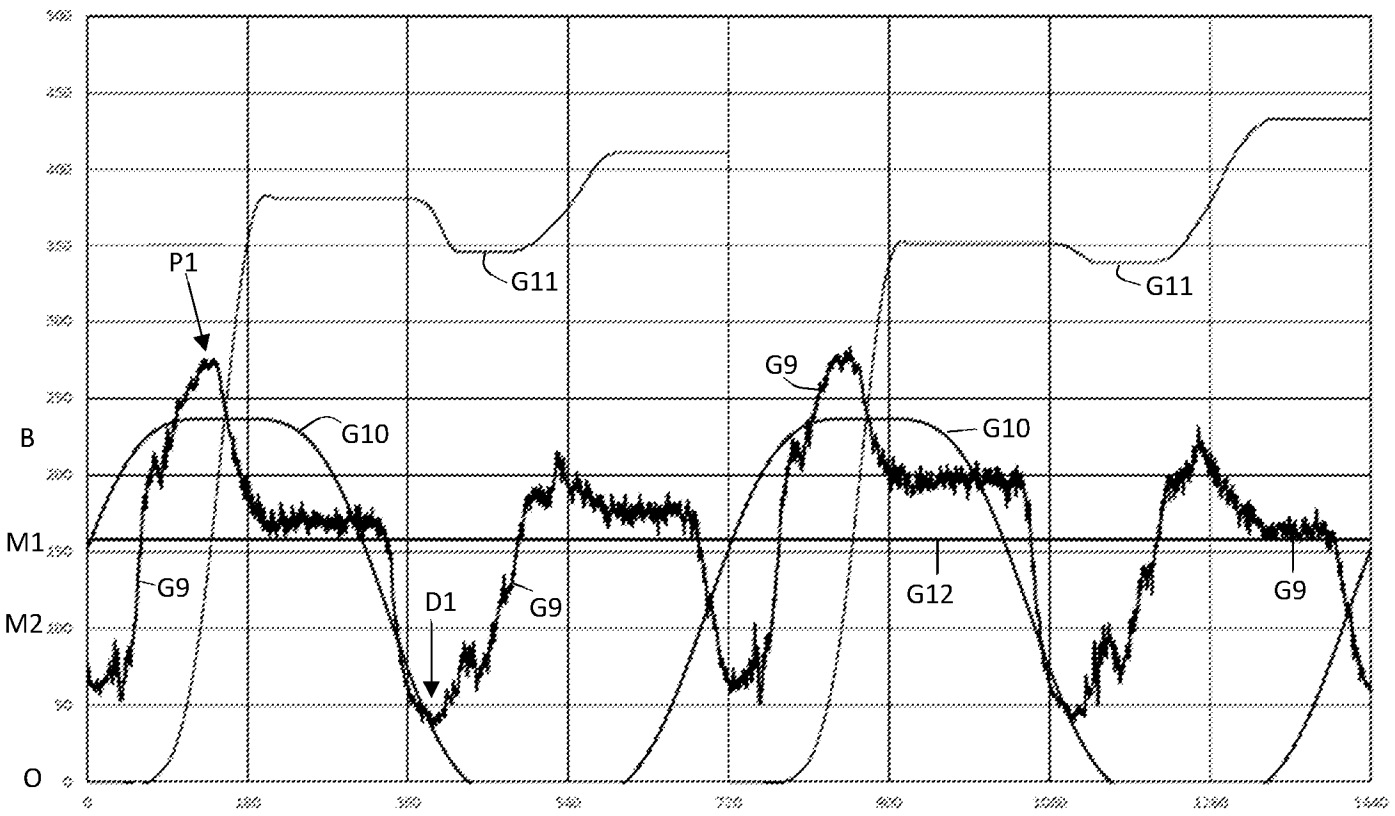

With reference to FIG. 5, it is shown that, according to the disclosure, a yarn tension profile may be obtained with lower maximum values and higher minimum values (lower peaks and higher troughs), with less variation in the yarn tension of a warp thread, as a first advantageous effect. In addition, because the yarn tension varies within a range with higher minimum values, this range can be lowered to a level at which the minimum values are still higher than the minimum required to guarantee good shed formation, good progress of the weaving process and excellent fabric quality. A second advantageous effect is therefore that the mean yarn tension can be lowered.

Figure 1:
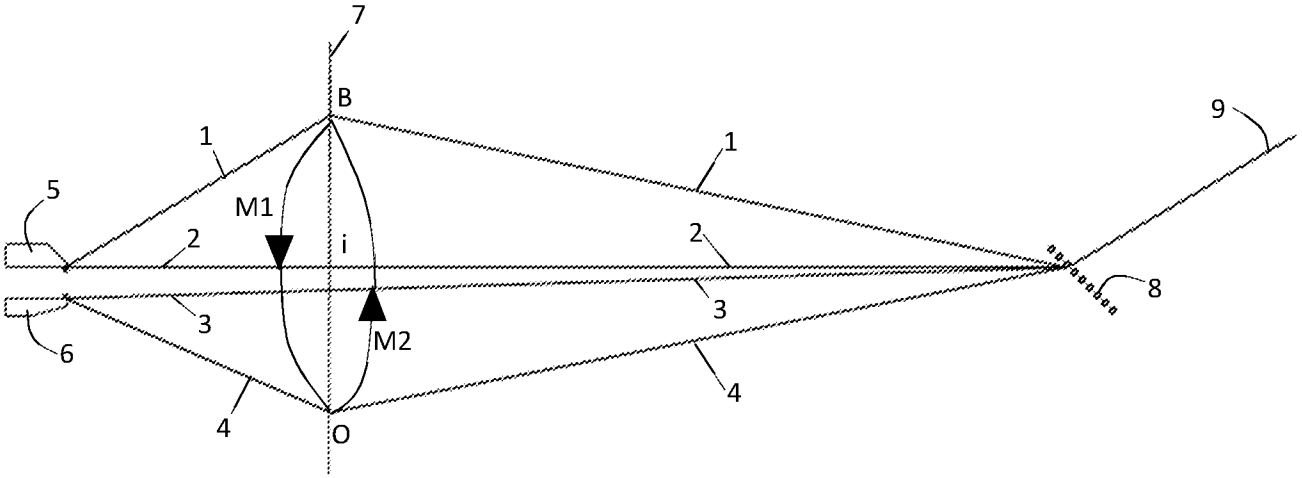
FIG. 1 is a diagrammatic representation of the shed geometry on a face-to-face weaving machine, indicating the movements of a heddle eye which positions a pile-forming pile-warp thread.
Figure 3:
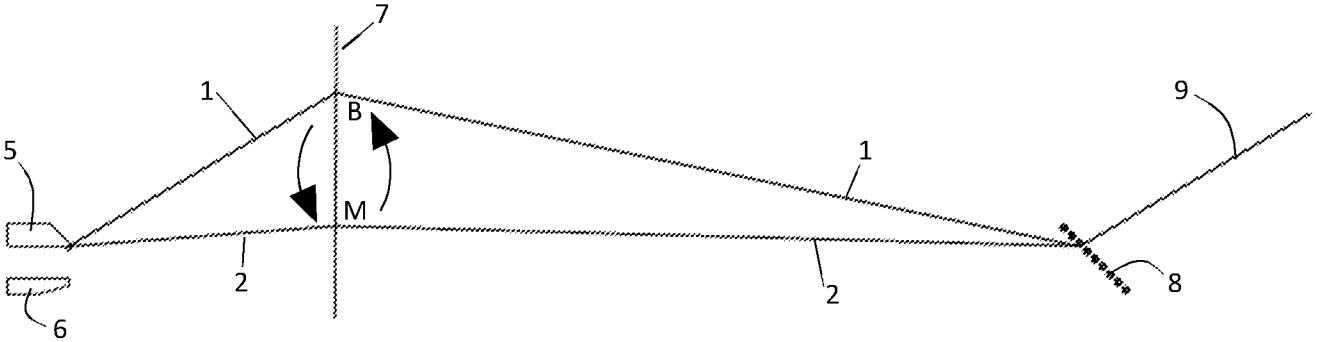
FIG. 3 is a diagrammatic representation of the shed geometry on a face-to-face weaving machine, indicating the movements of a heddle eye which positions a non-pile-forming pile-warp thread on its incorporation into the top ground fabric.

FIGS. 1 and 3 show the various possible positions of the warp threads during shed formation by means of a jacquard device on a face-to-face weaving machine, indicated symbolically by four straight position lines (1), (2), (3), (4) and by two straight position lines (1), (2) respectively.

These position lines (1), (2), (3), (4) run from the symbolically depicted upper bridge (5) or lower bridge (6) of a face-to-face weaving machine, via a jacquard machine (7) symbolically depicted by means of a vertical dotted line, to a grid (8) shown symbolically on the right of the drawings as a row of small circles. From the grid (8), the warp threads run to a bobbin creel which is not shown on the drawings. Part of the latter path of the warp threads is presented symbolically by means of a straight line (9).

The jacquard machine (7) is a known jacquard machine provided with a large number of heddles with respective heddle eyes and associated hooks, selection means and positioning means for positioning the heddles and the warp threads extending through these heddle eyes in successive weft insertion cycles, in a number of possible positions corresponding to a predefined weaving pattern.

In FIG. 1, a jacquard machine is shown with four possible positions for shed formation: a "bottom (O)" position, a "middle 1 (M1)" position, a "middle 2 (M2)" position and a "top (B)" position. The top position line (1) indicates the position of the warp threads which extend from the upper bridge (5) to a heddle brought to the "top (B)" position, and on to the grid (8). The position line (2) indicates the position of the warp threads which extend from the upper bridge (5) to a heddle brought into the "middle 1 (M1)" position and on to the grid (8). The position line (3) indicates the position of the warp threads which extend from the lower bridge (6) to a heddle brought to the "middle 2 (M2)" position and on to the grid (8). The bottom position line (4) indicates the position of the warp threads which extend from the lower bridge (6) to a heddle brought to the "bottom (O)" position and on to the grid (8).

A pile-warp thread which forms pile is brought successively, in successive weft insertion cycles, into the following positions: "middle 2 (M2)", "top (B)", "middle 1 (M1)" and "bottom (O)". See the indication of these movements on FIG. 1. The movement of the warp threads is determined in advance by the movement of the heddle eye (by the jacquard machine) but partly also by the geometry of the weaving machine.

Figure 2:
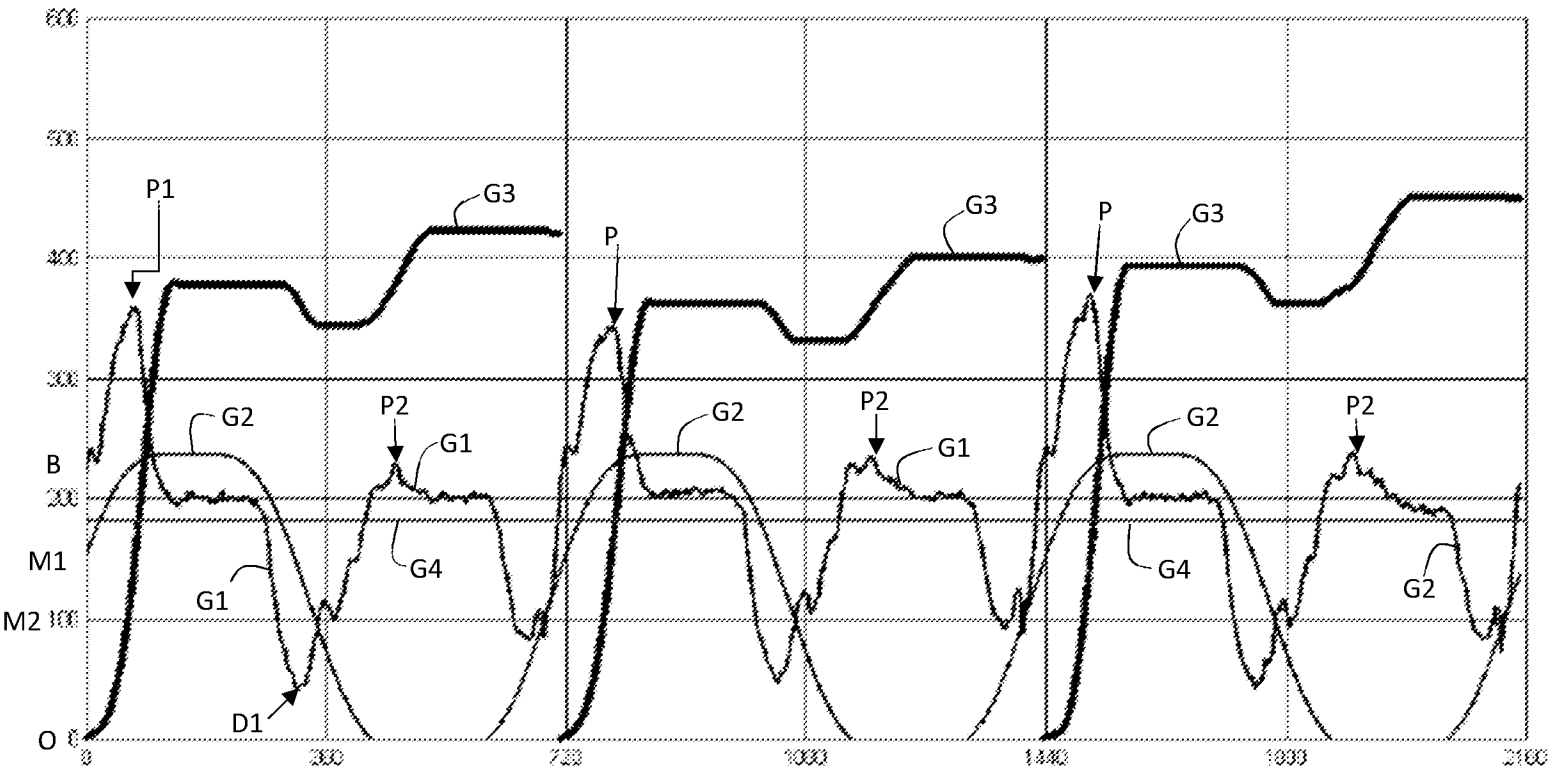
FIGS. 2, 4 and 5 show graphs which, for a warp thread in a number of successive weft insertion cycles, represent: the development of the yarn tension (in grams) in the pile-forming pile-warp thread, the development of the position of the heddle eye (in mm), and the total rotation angle (in degrees), over a complete machine cycle, of the brake roller of a yarn tensioning element; wherein FIGS. 2 and 4 respectively are related to a pile-forming pile-warp thread and a pile-warp thread incorporated into the top ground fabric, on use of a face-to-face weaving machine according to FIG. 1 and a yarn tensioning device which, according to the prior art, exerts a constant force on the warp threads.

FIG. 2 indicates how the yarn tension develops during a number of successive jacquard cycles for a pile-forming pile-warp thread with the successive heddle positions indicated above, wherein two weft insertion cycles take place during one jacquard cycle. The horizontal axis of FIG. 2 shows the degrees of rotation of the main shaft of the weaving machine. During two machine cycles or 720° on the horizontal axis, one jacquard cycle takes place. The vertical axis shows the values of the yarn tension (in gram) which are also the values of the movement of the heddle (in mm) and of the rotation of the roller of a yarn tensioning element (in degrees). FIG. 2 shows four graph lines (G1), (G2), (G3) and (G4) which are hereafter referred to as graph lines G1, G2, G3 and G4.

Graph line G1 shows the development of the yarn tension in the pile-forming warp thread.

Graph line G2 shows how the heddle eye which positions this pile-warp thread is moved in the meantime.

Graph line G3 indicates the total rotation of the roller of the yarn tensioning element which controls the tension of the warp thread during one jacquard cycle (after each jacquard cycle, the value of this rotation is returned to zero), wherein we emphasise that this yarn tensioning element according to the prior art exerts a constant force on the warp thread in order to keep this under tension.

Graph line G4 indicates the mean value of the yarn tension according to graph line G1.

Since the roller of the yarn tensioning element only rotates when the pile-warp yarn in contact with this roller is moved, both in the feed direction and in the opposite direction (on recuperation), the number of degrees of rotation of this roller can be used to derive the length of the pile-warp thread used. Accordingly, graph line G3 may also be regarded as an indication of the consumption of the supplied pile-warp yarn.

FIG. 2 shows the following for a number of successive jacquard cycles (2 weft insertion cycles):

- The heddle eye is moved from the "middle 2 (M2)" position to the "top (B)" position, as shown from the curve of graph line G2 from 0° on the horizontal axis. This movement begins slightly before 0°, which can be seen from the accumulated yarn tension at 0°.
- On graph line G3, we see that this is accompanied by a large rotation of the roller of the yarn tensioning element (hence a large consumption of pile-warp yarn), and on graph line G1 we see that this is accompanied by a rapid increase in yarn tension leading to a peak (P1).

When the heddle eye is stationary in the "top (B)" position (the horizontal top part of graph line G2), there is still a further take-up of yarn (see graph line G3). This surplus yarn feed, also called overflow, causes a fall in tension (graph line G1) until the yarn tension in the warp thread is normalized.

Then the heddle eye moves from the "top (B)" position to the "middle 1 (M1)" position (see graph line G2). This causes a large fall in yarn tension (see graph line G1) and sometimes a recuperation of warp thread occurs (see the small fall in graph line G3 just before reaching 360° machine cycle).

When the heddle eye then moves from the "middle 1 (M1)" position to the "bottom (O)" position (see graph line G2), the distance to be covered is smaller than in the movement from the "middle 2 (M2)" position to the "top (B)" position. The yarn tension therefore builds up more slowly. In addition, there is now a pull-back element, e.g. a spring, which exerts force on the heddle and hence on the yarn to pull it down. This slower tension build-up with a very small peak at the position of arrow (P2) is apparent from graph line G1. This graph line G1 also shows that the tension is constant when the heddle eye is moved in the "bottom (B)" position (the horizontal bottom part of graph line G2 in the region between 360° and 720°). Furthermore, it appears from the rotation of the roller of the yarn tensioning element (graph line G3) that a quantity of warp thread has been supplied in the meantime.

Then the heddle eye is again moved upward (see graph line G2), whereby the yarn tension falls (see graph line G1). This fall persists until the heddle eye has reached the "middle 2 (M2)" position. In this "middle 2 (M2)" position, the tension does not reach such a low value as in the "middle 1 (M1)" position. From there, the jacquard cycle begins again.

Graph line G4 is a horizontal line which indicates the mean value of the yarn tension according to graph line G1.

FIG. 3 shows a jacquard machine in which two possible positions are used: a "middle (M)" position and a "top (B)" position. The top position line (1) indicates the position of the warp threads which extend from the upper bridge (5) to a heddle brought to the "top (B)" position. The bottom position line (2) indicates the position of the warp threads which extend from the upper bridge (5) to a heddle brought to the "middle (M)" position.

A pile-warp thread which is incorporated into the top ground fabric is moved successively, in successive weft insertion cycles, into the "top (B)" and "middle (M)" positions. See the indication of these movements on FIG. 3.

Figure 4:
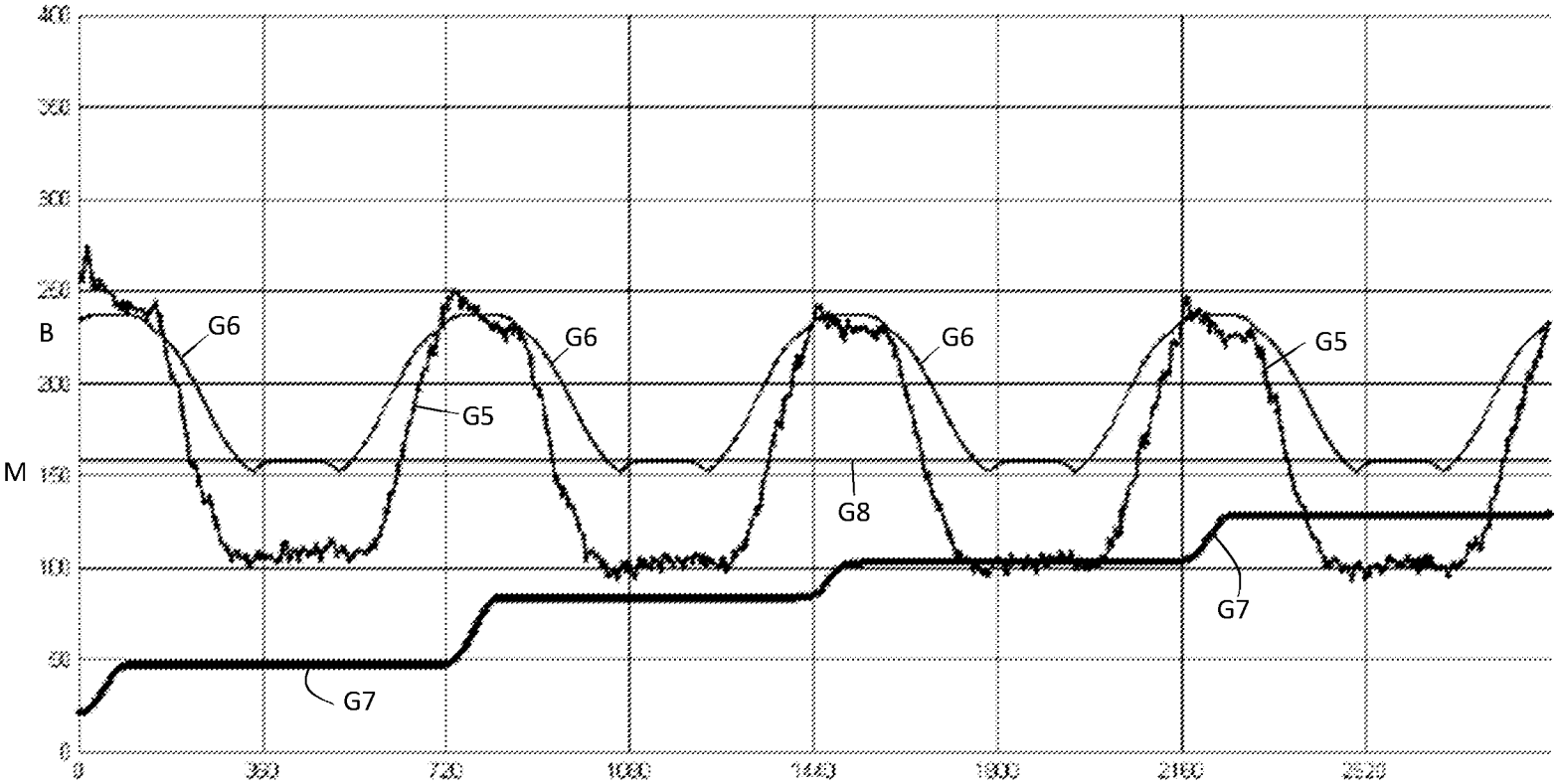

FIG. 4 shows how the yarn tension develops during a number of successive jacquard cycles for a pile-warp thread incorporated into the top ground fabric with the successive heddle positions indicated above. Similarly to FIG. 2, the horizontal axis shows the rotation of the main shaft of the weaving machine (in degrees). During two machine cycles, or 720° on the horizontal axis, one jacquard cycle takes place. The vertical axis, just as in FIG. 2, shows the values of the yarn tension (in grams) which are also values of the movement of the heddle (in mm) and of the rotation of the roller of the yarn tensioning element (in degrees). FIG. 4 again shows four graph lines (G5), (G6), (G7, (G8) which are hereafter referred to as graph lines G5, G6, G7, and G8, and which respectively indicate the development of the yarn tension in the incorporated pile-warp thread, the movements of the heddle eye which positions this pile-warp thread, the total rotation of the roller of the yarn tensioning element which controls the tension of the pile-warp threads during one jacquard cycle (this yarn tensioning element according to the prior art exerts a constant force on the warp thread in order to keep this under tension), and the mean value of the yarn tension according to graph line G5. The indications on the horizontal and vertical axes of FIG. 4 are identical to those of FIG. 2.

FIG. 4 shows the following for a number of successive jacquard cycles (2 weft insertion cycles):

The heddle eye is moved from the "top (B)" position to the "middle (M)" position under the influence of the downward force exerted by a spring or other return element on the heddle, as apparent from the curve of graph line G6 from 0° on the horizontal axis. As the curve of graph line G6 shows, the yarn tension thereby falls to a minimum and remains approximately the same when the heddle is stationary in the "middle (M)" position, the warp thread is still under tension but under a much lower tension than in the "top (B)" position.

The heddle eye is then moved from the position "middle (M)" to the position "top (B)" (see graph line G6), whereby the yarn tension builds up again to a maximum when the heddle eye is in the "top (B)" position. In the meantime, there is a small consumption of the pile-warp yarn (see graph line G7). From there, the jacquard cycle begins again.

Graph line G8 is a horizontal line which shows the mean value of the yarn tension according to graph line G5.

As can be clearly seen from comparison of the graph line G1 on FIG. 2 and graph line G5 on FIG. 4, the development of the yarn tension in a pile-forming pile-warp thread differs greatly from the yarn tension in a pile-warp thread which is incorporated. When a pile-warp thread is incorporated, there is only one peak of yarn tension per jacquard cycle, while there are two tension peaks in a pile-forming pile-warp thread. Also, the yarn is not pulled as hard, whereby for an incorporated pile-warp thread, the yarn tensions achieved are not as high. As a result, there is rarely or never any yarn overflow.

When a method and a yarn tensioning device according to this disclosure are used, wherein each pile-warp thread cooperates with a respective yarn tensioning element and wherein a control unit controls the yarn tension via this yarn tensioning element in order to follow a first reference yarn tension profile when the pile-warp thread forms pile, and to follow a second reference yarn tension profile when the pile-warp thread is incorporated into the top ground fabric, a yarn tension profile may be obtained with lower maximum values and higher minimum values (lower peaks and higher troughs), whereby lower yarn tensions may be applied. These advantageous effects are illustrated in FIG. 5, which shows, for a number of successive jacquard cycles, the yarn tension profile of a pile-forming pile-warp thread, with the same successive heddle positions as in FIG. 2, while the yarn tension is controlled according to this disclosure.

The horizontal axis of FIG. 5 shows the rotation of the weaving machine main shaft (in degrees). The vertical axis again shows the values of the yarn tension (in grams) which are also the values of the movement of the heddle (in mm) and of the rotation of the roller of the yarn tensioning element (in degrees). FIG. 5 shows four graph lines (G9), (G10), (G11) and (G12), which are referred to below as graph lines G9, G10, G11 and G12, and which respectively indicate the development of the same variables as the graph lines (G1)-(G4) on FIG. 2, namely yarn tension in the pile-warp thread (G9), movement of the heddle eye (G10), rotation of the roller of the yarn tensioning element (G11), and the mean yarn tension in the pile-warp thread (G12).

By comparing the development of yarn tension according to graph line G1 on FIG. 2 and the development of yarn tension according to graph line G9 on FIG. 5, it is clear that the yarn tension according to graph line G9 builds up as quickly as according to graph line G1, but that the maximum value of the peak (P1) of graph line G9 is lower than the maximum value of the peak (P1) of graph line G1.

Both graph lines (G1, G9) reach approximately the same minimum value in their trough (D1), which indicates that the yarn tension remains sufficiently high to be able to guarantee a good progress of the weaving process in general and of the shed formation in particular, and provides fabrics of excellent quality. The variation in yarn tension (the difference between the maximum value and minimum value) according to graph line G9 is thus also lower than according to graph line G1.

By comparing graph line G4 on FIG. 2 and graph line G12 on FIG. 5, it is also shown that the mean yarn tension according to graph line G12 is significantly lower than the mean yarn tension according to graph line G4.

Figure 6:
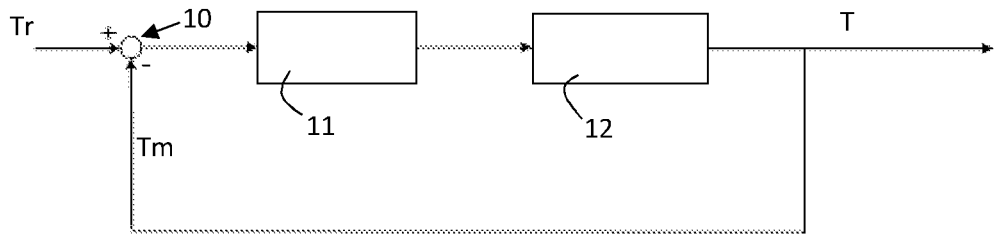
FIG. 6 shows a block diagram of the principle of control of the yarn tension according to a method of this disclosure.

FIG. 6 shows the principle of a control unit for a weaving machine according to this disclosure in a block diagram. The yarn tension ($T_M$) in a warp thread is measured and compared in a comparator (10) with a specific reference value ($T_R$) for this yarn tension. Alternatively, a variable which is a measure of this yarn tension may be measured and compared with a reference value for this variable.

If a difference is found between the measured value ($T_M$) and the reference value ($T_R$), a regulator (11) is activated so as to intervene on the motor torque or current which controls the motor of the yarn tensioning element (12), so that this yarn tensioning element (12) changes the yarn tension such that the established difference is reduced. The yarn tension (T) in a warp thread is thus brought closer to or up to the reference value ($T_R$).

Figure 7:
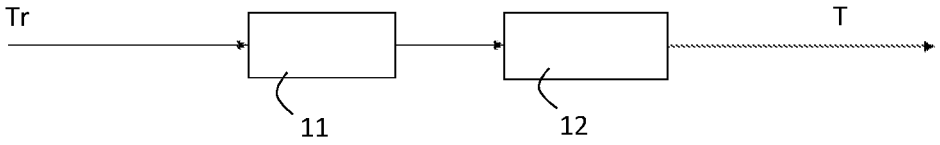
FIG. 7 shows a block diagram of the principle of steering of the yarn tension according to a method of this disclosure.

FIG. 7 shows the principle of a steering unit for a weaving machine according to this disclosure in a block diagram. A reference value ($T_R$) for the yarn tension is input into a regulator, which as a result intervenes on the motor torque or current which controls the motor of the yarn tensioning element (12), so that this yarn tensioning element (12) brings the yarn tension (T) to a value which corresponds to the reference value ($T_R$).

Machine parameters such as the machine position or machine speed or data connected with the weaving pattern or weave structure may be made available to the regulator according to FIG. 6 and according to FIG. 7, wherein one or more of these parameters may be used for control or adjustment.

The invention claimed is:

1. Method for weaving a fabric on a weaving machine, wherein:

in successive weft insertion cycles, at least one weft thread is inserted at a weft insertion level between warp threads, the warp threads in each weft insertion cycle are positioned relative to each weft insertion level such that the warp threads and the weft threads inserted in between together form a fabric according to a predefined weaving pattern, and the yarn tension of a group of warp threads which comprises at least some of the warp threads is controlled or adjusted by means of a yarn tensioning device, wherein the group of warp threads comprises several part groups with at least one warp thread, that the yarn tension of the warp threads is controlled or adjusted separately per part group in order to follow a respective reference yarn tension profile during weaving; that for at least one part group, the reference yarn tension profile to be followed is changed during weaving; and that for at least two part groups, the reference yarn tension profile to be followed during weaving is determined and changed separately, wherein each reference yarn tension profile is selected from a collection of at least two different reference yarn tension profiles.

2. Method for weaving a fabric according to claim 1, wherein a respective different reference yarn tension profile is provided for at least two different statuses of a yarn tension influencing property of a warp thread, and that for at least one part group, the reference yarn tension profile to be followed during weaving is determined and changed as a function of the status of each warp thread of the part group.

3. Method for weaving a fabric according to claim 2, wherein the at least two different statuses of the yarn tension influencing property of a warp thread are:

at least two different phases of the weaving cycle in which a warp thread is processed into the fabric, or at least two different places on the weaving machine at which a warp thread is located during weaving process, or at least two different paths which a warp thread follows from a yarn store to the fabric, or at least two different degrees of contact which a warp thread makes with other warp threads and/or with yarn guide means on its path from a yarn store to the fabric, or at least two different sizes of forces which counter the movement of a warp thread towards the weaving machine on its path from a yarn store to the fabric, or at least two different inertias of a yarn storage bobbin from which the warp thread is unwound during the weaving process by rotation of the yarn storage bobbin, or at least two different bobbin places at which the warp thread is unwound.

4. Method for weaving a fabric according to claim 1, wherein a respective different reference yarn tension profile is provided for at least two different weave statuses of a warp thread in the fabric to be woven, and that for at least one part group, the reference yarn tension profile to be followed during weaving is determined and changed as a function of the weave structure of each warp thread of the part group, as provided according to the weaving pattern.

5. Method for weaving a fabric according to claim 1, wherein at least a number of part groups, preferably all part groups, comprise only one warp thread.

6. Method for weaving a fabric according to claim 4, wherein it is a method for weaving pile fabrics, in which at least one ground fabric is woven from warp threads and weft threads, and wherein pile-warp threads are provided in order to form pile and/or be incorporated into a ground fabric without forming pile, according to the weaving pattern; that a pile-forming pile-warp thread has a first weave status and a pile-warp thread which is incorporated into a ground fabric without forming pile has a second weave status; that a first and a second reference yarn tension profile are provided for the first and second weave statuses respectively; and that the reference yarn tension profile to be followed during weaving is determined and changed as a function of the presence or absence of a first or a second weave status of each pile-warp thread of the part group, according to the weaving pattern.

7. Method for weaving a fabric according to claim 4, wherein it is a method for weaving a pile fabric, in which at least one ground fabric is woven from warp threads and weft threads, and wherein pile-warp threads are provided in order to form pile and/or be incorporated into one of the ground fabrics without forming pile, according to the weaving pattern; that at least one pile-warp thread has a pile-forming part and a non-pile-forming part; that the transition from a pile-forming part to a non-pile-forming part of a pile-warp thread has a third weave status; that a third reference yarn tension profile is provided for the third weave status; and that the reference yarn tension profile to be followed during weaving is determined and changed as a function of the presence or absence of a third weave status of each pile-warp thread of the part group, according to the weaving pattern.

8. Method for weaving a fabric according to claim 4, wherein it is a method for weaving a pile fabric, in which at least one ground fabric is woven from warp threads and weft threads, and wherein pile-warp threads are provided in order to form pile and/or be incorporated into one of the ground fabrics without forming pile, according to the weaving pattern; that at least one pile-warp thread has a pile-forming part and a non-pile-forming part; that the transition from a non-pile-forming part to a pile-forming part of a pile-warp thread has a fourth weave status; that a fourth reference yarn tension profile is provided for the fourth weave status; and that the reference yarn tension profile to be followed during weaving is determined and changed as a function of the presence or absence of a fourth weave status of each pile-warp thread of the part group, according to the weaving pattern.

9. Method for weaving a fabric according to claim 4, wherein it is a face-to-face weaving method in which two ground fabrics are woven one above the other from respective warp threads and weft threads, wherein the pile-warp threads on the mutually facing sides of the ground fabrics form a pile on at least one of the ground fabrics in that pile-warp threads are interlaced alternately into the one and the other ground fabric and cut through between the two ground fabrics so as to form cut pile on both ground fabrics, and/or in that pile loops are formed on at least one of the ground fabrics, and/or in that pile-warp threads on at least one of the ground fabrics form ribs running over weft threads on the fabric surface.

10. Method for weaving a fabric according to claim 4, wherein it is a fabric with a cut pile and/or a loop pile and/or a rib-forming structure, such as amongst others a false bouclé fabric or a fabric with sisal appearance.

11. Method for weaving a fabric according to claim 1, wherein, to influence the yarn tension of the warp threads, a yarn tensioning element is provided per part group and comprises at least one roller that can be driven by an electric motor and that is in contact with each warp thread of the part group, wherein the electric motor has a cogging torque which is at least 5% and most 20% of the nominal torque of the motor.

12. Method for weaving a fabric according to claim 1, wherein, per part group, a yarn tensioning element is provided which comprises at least one roller that can be driven by an electric motor and is in contact with each warp thread of the part group, wherein the electric motor has a nominal torque of at least 0.005 Nm and at most 0.2 Nm.

13. Weaving machine comprising:

weft insertion means in order, in successive weft insertion cycles, to insert at least one weft thread at a weft insertion level between warp threads, shed-forming means for positioning the warp threads in each weft insertion cycle relative to each weft insertion level such that the warp threads and the weft threads inserted in between together form a fabric according to a predefined weaving pattern, and a yarn tensioning device for controlling or adjusting the yarn tension of the group of warp threads which comprises at least part of the warp threads, wherein the yarn tensioning device comprises several yarn tensioning elements which are provided for changing the yarn tension in the warp threads of respective part groups of the group of warp threads, and a control or steering unit which is provided, in cooperation with the yarn tensioning elements, to adjust or control the yarn tension in the warp threads separately per part group in order to follow a respective reference yarn tension profile during weaving, wherein each part group comprises at least one warp thread; that the control or steering unit is provided to change the reference yarn tension profile to be followed during weaving for at least one part group; that the yarn tension device comprises a storage unit in which a collection of at least two different reference yarn tension profiles is provided; and that the control or steering unit is provided, for at least two part groups, to determine the reference yarn tension profile to be followed during weaving by selection from said collection.

14. Weaving machine according to claim 13, wherein the weaving machine is provided with a group of warp threads which comprises several part groups with at least one warp thread; that in the storage unit a respective different reference yarn tension profile is provided for at least two different statuses of a yarn tensioning influencing property of a warp thread; and that the control or steering unit is provided, for at least one part group, to determine the reference yarn tension profile to be followed during weaving and change this as a function of the status of each warp thread of the part group.

15. Weaving machine according to claim 14, wherein the at least two different statuses of a yarn tension influencing property of a warp thread are:

at least two different phases of the weaving cycle in which a warp thread is processed into the fabric, or at least two different places on the weaving machine at which a warp thread is located during the weaving process, or at least two different paths which a warp thread follows from a yarn store to the fabric, or at least two different degrees of contact which a warp thread makes with other warp threads and/or with yarn guide means on its path from a yarn store to the fabric, or at least two different sizes of forces which counter the movement of a warp thread towards the weaving machine on its path from a yarn store to the fabric, or at least two different inertias of a yarn storage bobbin from which the warp thread is unwound during the weaving process by rotation of the yarn storage bobbin, or at least two different bobbin places at which the warp thread is unwound.

16. Weaving machine according to claim 13, wherein the yarn tensioning device comprises a storage unit in which a respective different reference yarn tension profile is provided for at least two different weave statuses of a warp thread in the fabric to be woven; and that the control or steering unit is provided, for at least one part group, to determine the reference yarn tension profile to be followed during weaving and change this as a function of the weave status of each warp thread of the part group, as provided according to the weaving pattern.

17. Weaving machine according to claim 13, wherein at least a number of part groups, preferably all part groups, comprise only one warp thread.

18. Weaving machine according to claim 16, wherein it is a weaving machine which is provided for weaving pile fabrics, wherein at least one ground fabric is woven from warp threads and weft threads, and wherein pile-warp threads are provided in order to form pile and/or be incorporated into a ground fabric without forming pile, according to the weaving pattern; that a pile-forming pile-warp thread has a first weave status and a pile-warp thread which is incorporated into a ground fabric without forming pile has a second weave status; that a first and a second reference yarn tension profile are provided for the first and second weave statuses respectively; and the control or steering unit is provided in order to determine the reference yarn tension profile to be followed during weaving and change this as a function of the presence or absence of a first or a second weave status of each pile-warp thread of the part group, according to the weaving pattern.

19. Weaving machine according to claim 16, wherein it is a weaving machine which is provided for weaving a pile fabric, wherein at one ground fabric is woven from warp threads and weft threads, and wherein pile-warp threads are provided in order to form pile and/or be incorporated into a ground fabric without forming pile, according to the weaving pattern; that at least one pile-warp thread has a pile-forming part and a non-pile-forming part; that the transition from a pile-forming part to a non-pile-forming part of a pile-warp thread has a third weave status; that a third reference yarn tension profile is provided for the third weave status; and that the control or steering unit is provided in order to determine the reference yarn tension profile to be followed during weaving and change this as a function of the presence or absence of a third weave status of each pile-warp thread of the part group, according to the weaving pattern.

20. Weaving machine according to claim 16, wherein it is a weaving machine which is provided for weaving a pile fabric, wherein at least one ground fabric is woven from warp threads and weft threads, and wherein pile-warp threads are provided in order to form pile and/or be incorporated into one of the ground fabrics without forming pile, according to the weaving pattern; that at least one pile-warp thread has a pile-forming part and a non-pile-forming part; that the transition from a non-pile-forming part to a pile-forming part of a pile-warp thread has a fourth weave status; that a fourth reference yarn tension profile is provided for the fourth weave status; and that the control or steering unit is provided in order to determine the reference yarn tension profile to be followed during weaving and change this as a function of the presence or absence of a fourth weave status of each pile-warp thread of the part group, according to the weaving pattern.

21. Weaving machine according to claim 16, wherein it is a face-to-face weaving machine.

22. Weaving machine according to claim 21, wherein the weaving machine is provided to weave two ground fabrics one above the other from respective warp threads and weft threads, wherein the pile-warp threads on the mutually facing sides of the ground fabrics form a pile on at least one of the ground fabrics in that pile-warp threads are interlaced alternately into the one and the other ground fabric and cut through between the two ground fabrics so as to form cut pile on both ground fabrics, and/or in that pile loops are formed on at least one of the ground fabrics, and/or in that pile-warp threads on at least one of the ground fabrics form ribs running over weft threads on the fabric surface.

23. Weaving machine according to claim 13, wherein said yarn tensioning elements comprise at least one roller that can be driven by an electric motor and is intended to be in contact with at least one warp thread, wherein the electric motor has a cogging torque which is at least 5% and most 20% of the nominal torque of the motor.

24. Weaving machine according to claim 13, wherein the yarn tensioning elements comprise at least one roller that can be driven by an electric motor and is intended to be in contact with at least one warp thread, and that the electric motor has a nominal torque which is at least 0.005 Nm and at most 0.2 Nm.

* * * * *